US005136736A

United States Patent [19]

Bishop

[11] Patent Number: 5,136,736

[45] Date of Patent: Aug. 11, 1992

[54] SINK ACCESSORY FOR SOAKING, WASHING OR RINSING DISHES

[76] Inventor: Roger M. Bishop, 18219 Joplin Rd., Triangle, Va. 22172

[21] Appl. No.: 706,563

[22] Filed: May 28, 1991

Related U.S. Application Data

[63] Continuation of Ser. No. 547,290, Jul. 3, 1990, abandoned.

[51] Int. Cl.[5] ..... E03C 1/01

[52] U.S. Cl. ..... 4/641; 4/514; 4/654

[58] Field of Search ..... 4/638–642, 4/651, 654, 656, 206, 514, 553; 134/115 R, 183

[56] References Cited

U.S. PATENT DOCUMENTS

| | | | |
|---|---|---|---|
| 1,769,165 | 7/1930 | Rhoades et al. | 134/115 R X |
| 1,842,289 | 1/1932 | Russel | 4/641 |
| 2,205,018 | 6/1940 | Osuch | 4/641 |
| 2,765,476 | 10/1956 | Moore | 4/514 |
| 2,784,418 | 3/1957 | Luoma | 4/514 |
| 4,264,991 | 5/1981 | Lasalandra | 4/514 |
| 4,336,620 | 6/1982 | Gresh | 4/651 X |

FOREIGN PATENT DOCUMENTS

| | | | |
|---|---|---|---|
| 830500 | 12/1936 | France | 4/514 |
| 313347 | 4/1956 | Switzerland | 4/640 |
| 1682 | of 1899 | United Kingdom | 4/651 |
| 477459 | 12/1937 | United Kingdom | 4/651 |

*Primary Examiner*—Charles E. Phillips

[57] ABSTRACT

An accessory for use as an insert in a sink comprising a bowl having upstanding end walls and side walls, and a bottom, an internal wall substantially parallel to and spaced from one of the end and side walls and of a height less than the height of the end and side walls so as to form an overflow chamber in the bowl, a first drain opening in the end wall in the overflow chamber, the internal wall having a hollow passageway formed therein and open at the top thereof and a second drain opening through the internal wall and the passageway, a valve member in the passageway for selectively opening and closing the second drain opening, the valve member having a portion extending above the walls to act as a handle, and permit draining the water without reaching into the water.

15 Claims, 2 Drawing Sheets

SINK ACCESSORY FOR SOAKING, WASHING OR RINSING DISHES

CROSS-REFERENCE TO RELATED APPLICATIONS

This application is a continuation of application Ser. No. 07/547,290 filed Jul. 3, 1990, and now abandoned.

This invention relates to an accessory for soaking or rinsing dishes. More particularly, the invention relates to an accessory for use with a conventional kitchen sink, which will permit a more convenient soaking or rinsing of dishes, but which may also be used for dishwashing insert freestanding.

BACKGROUND AND OBJECTS OF THE INVENTION

A number of different types of devices have been proposed in the past to facilitate the chore of washing dishes. Most notably, dishwashers have become quite common in new homes, but their installation in older homes is still a difficult and expensive project which tends to be avoided. Thus, dishwashing remains a chore in many dwellings.

Even in new, modern homes, equipped with modern dishwashers, the busy lifestyles of so many people are such that they prefer not having to deal with dirty dishes right after a meal, and would rather put off the task until more time is available. Even putting the dishes in a dishwasher is a time consuming task which often is deferred until later in the day, or even the next day. But, when the dishes are not washed immediately, the food dries on the dishes and is more difficult, and even more time consuming, to wash later.

Some devices have been proposed to help alleviate the task of washing dishes, and these devices have met with varying degrees of success, depending upon the nature of the accessory. One such device is in the nature of an insert for a conventional sink, and serves as a dish rinser. Such a device is shown in U.S. Pat. No. 4,336,620 to Gresh, and primarily comprises an insert for the sink. The insert is very similar to the sink itself, but is lower in its height, so that any grease which floats on the water in the insert may be skimmed off. This device, however, provides very little benefit over the conventional sink, and of course is of lesser capacity than the regular sink with which it is used.

Another type of insert is intended to be used with a tub. Such an insert is disclosed in U.S. Pat. No. 1,842,289 to Russel, and enables the tub to function as a kitchen sink with a drainboard. However, such an insert seems to significantly reduce the capacity of the tub.

Still another insert is disclosed in U.S. Pat. No. 2,205,018 to Osuch, which describes an insert which permits a tub to be used as a sink.

The foregoing inserts as described in the prior art, all suffer from various disadvantages and combinations of disadvantages. For example, a leading disadvantage is that the prior inserts tend to reduce the usable capacity of the sink, meaning that less dishes may be washed or that an overflow condition is more likely to develop during use.

Another disadvantage is that difficulty is encountered in draining the water from the insert. The need to reach into the dirty, greasy water is distasteful to many persons. When this is coupled with the reduced capacity, little need remains for the prior types of sink inserts, and thus they have achieved little, if any success.

Accordingly, a primary object of this invention is to overcome the disadvantages of prior sink inserts.

Another object of the invention is to provide a sink insert which may be used with conventional kitchen sinks to facilitate the rinsing and/or soaking of dishes, pots, pans, and the like.

A further object of the invention is to provide an insert for a kitchen sink which does not reduce, but may even increase, the capacity of the conventional sink with which is it used.

Yet another object of the invention is to provide a sink insert having a drain which may be opened or closed without reaching into the water.

Still another object of the invention is to provide a sink insert which has an overflow which helps to prevent water from spilling out of the insert onto the adjacent counter when adding dishes, water, etc.

Yet a further object of the invention is to provide a more versatile sink insert which may be used as a freestanding sink for soaking, washing or rinsing dishes, and may be easily drained into the standard kitchen sink.

DESCRIPTION OF THE INVENTION

The present invention comprises an insert for use with a conventional kitchen sink, but which provides advantages, particularly in manner in which the sink may be used to clean dishes. Preferably the insert is of molded plastic, with the drain gate valve being the only moving part. The invention may be used as an insert with a conventional sink, but may also be used in a freestanding manner as an additional sink on an adjacent countertop.

The insert has a primary or main bowl which is of a shape complementary to that of a standard kitchen sink, and preferably, the insert according to the invention is about two to three inches higher than the depth of an ordinary kitchen sink. This will enable the insert to fit easily into the sink and be filled from the conventional faucet, and will not interfere with the faucet.

The accessory according to the invention has an internal wall to enable the overflow arrangement. The internal wall creates an overflow chamber into which water will flow before it can spill onto the counter. With this overflow arrangement, the accessory does not reduce the capacity of the conventional sink, and because the insert is higher than the depth of the sink, the insert in fact increases the capacity, but without the risk of overflowing onto the counter or the floor, since the overflow chamber outlets into the sink directly, rather than over the sides. The internal wall or weir is preferably integrally molded with the remainder of the bowl, with a height slightly less than the height of the insert.

This weir has a hollow passageway in the center section to enable it to receive a sliding gate valve. This gate valve is substantially vertically arranged, and has an actuator stem extending upwardly through and out of the weir. In this manner, the actuator stem rises above the level of the water in the insert, and the user may grasp the actuator stem and move it up or down to open or close the gate, without reaching into the water.

At the bottom of the weir, there is an opening passing through the internal wall between the primary chamber and the overflow chamber, which opening is closed by the gate valve. In the overflow chamber side, the overflow chamber is provided with an opening near the bottom. In this manner, any water which overflows the weir into the overflow chamber, as well as water released when the gate valve is opened, will drain into the conventional sink drain. Since this opening is at one end of the insert, when the insert is placed on the countertop adjacent to the sink, the opening may be placed slightly over the edge of the sink, and water in the insert may be drained (or overflow) directly into the sink, rather than onto the counter-top, or could similarly be drained into another receptacle.

DESCRIPTION OF THE DRAWINGS

The invention will be described in greater detail in the section which follows, with reference to the accompanying drawings which show by way of a non-limiting example, a preferred embodiment of the invention. In these drawings, which form an integral part of this specification.

DETAILED DESCRIPTION OF PREFERRED EMBODIMENTS

Figure 1:
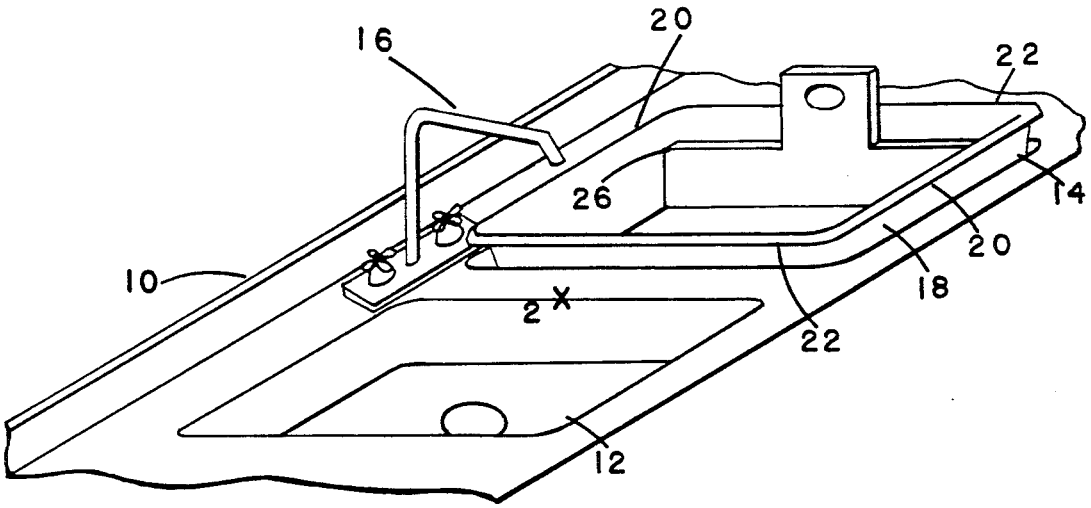
FIG. 1 is a perspective view of a conventional double bowl kitchen sink, with an insert according to the invention in place therein.
Figure 2:
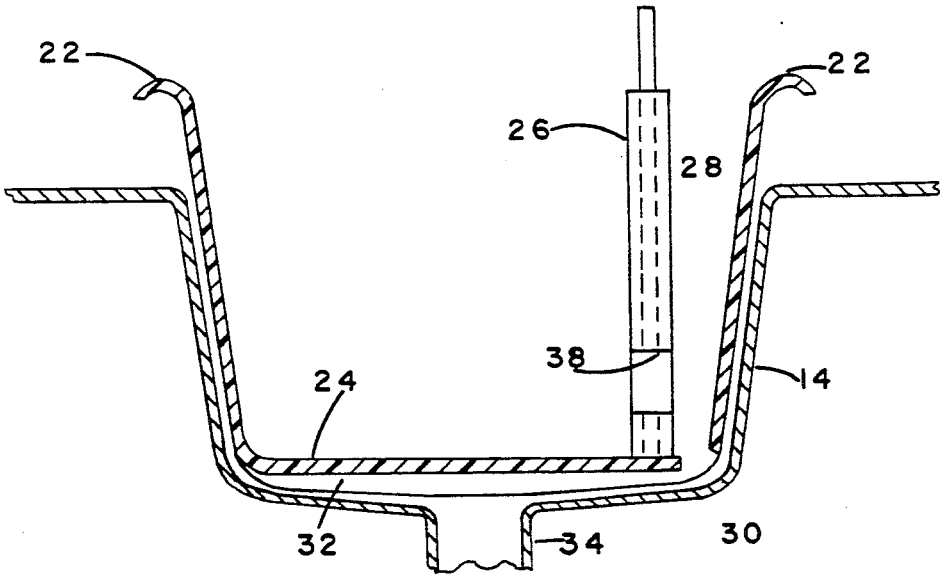
FIG. 2 is a longitudinal cross-sectional view of the accessory along lines 2—2 of FIG. 1 and viewed in the direction of the arrows.
Figure 3:
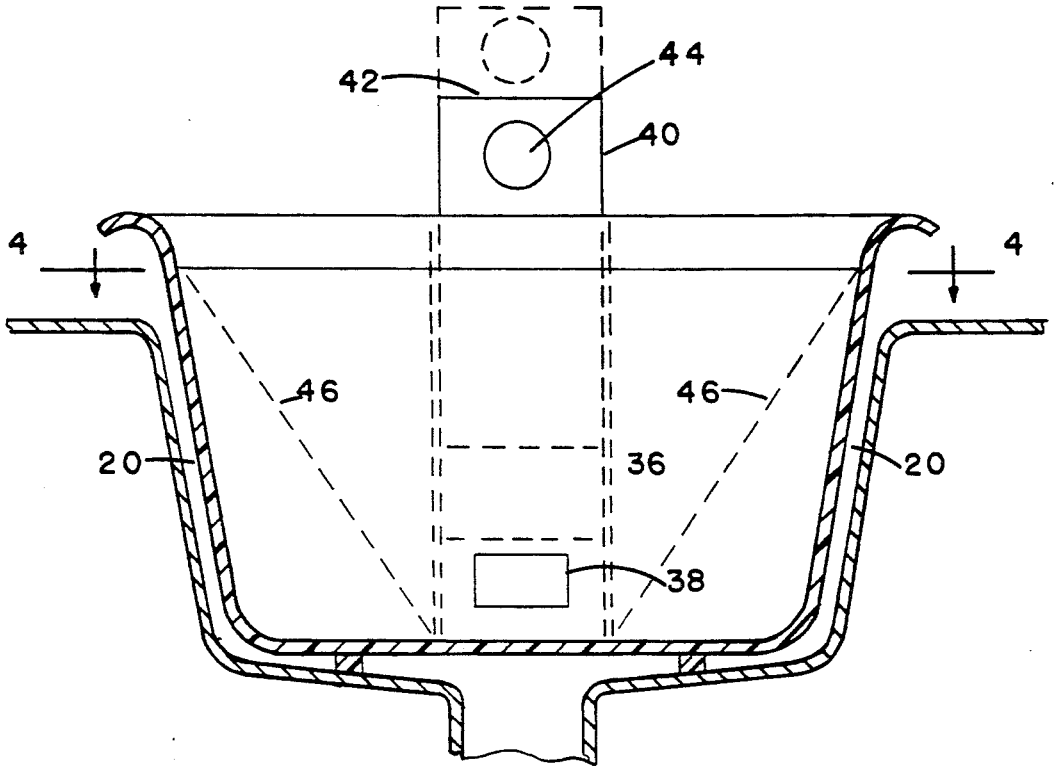
FIG. 3 is a transverse cross-sectional view of the accessory.
Figure 4:
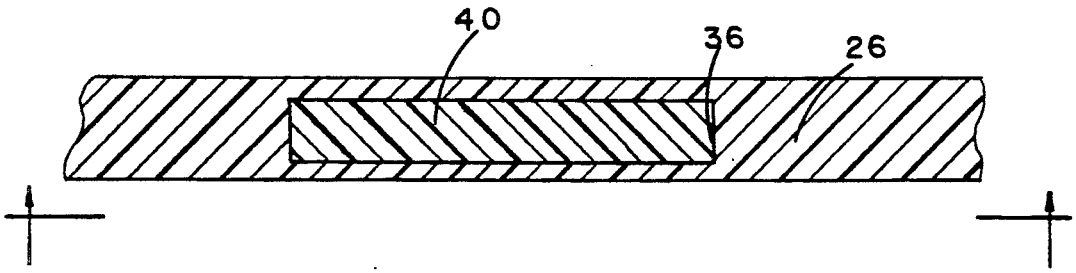
FIG. 4 is a fragmentary sectional view along lines 4—4 of FIG. 3 and viewed in the direction of the arrows.

Referring to FIGS. 1 through 4, a kitchen countertop 10 is shown with a conventional double bowl kitchen sink installed therein. The bowls 12 and 14 of the sink also have an associated water faucet 16 as is conventional. The insert 18 according to the invention is of a size such that it is slightly smaller than the sink bowl 14, in order that the insert may easily nest into the sink bowl.

The insert 18 includes side walls 20 and end walls 22, a bottom 24, and an internal wall 26. The side walls 20 and end walls 22 are all of the same height, which is preferably on the order of 2–3 inches higher than the depth of a conventional kitchen sink, while the internal wall 26 should preferably be about one inch shorter than the walls 20, 22. In this manner, any water in the insert must overflow the inner wall 26 before it can overflow the outer walls 20, 22.

The internal wall 26 is spaced slightly away from, and parallel to, one end wall 22 (although is could be spaced from and parallel to a side wall 20) in order to provide the overflow or drain chamber 28. At the bottom of this drain chamber 28 is an opening 30.

On the underside of the bottom wall 24 are two or more spaced ribs 32 which serve to space the bottom wall 24 from the bottom of the sink slightly, such that water may flow between the bottom wall 24 and the sink bowl 14. In this manner, any water which flows out of the opening 30 in the accessory will flow into the sink bowl 14 and to the conventional sink drain 34.

The internal wall 26 is preferably molded integrally with the insert, and has a hollow vertical passageway 36 molded therein. Near the bottom of the wall and passing through the passageway 36 is an opening 38 which serves as a drain passage for the primary chamber of the accessory. A valve gate or slide 40 is provided to slide in the passageway 36 and to close the opening 38.

The valve member 40 has an upward extension or handle 42 which extends above the top of the side and end walls 20, 22, and of course above the internal wall 26. This handle 42 may also be provided with a hole 44. In this manner, the user may easily grasp the handle 42 or the opening 44 in order to open or close the opening 38 by moving the slide 40 up or down in the passageway 36.

In the simplest form of the invention, the valve member 40 is simply a molded, elongated rectangular member of a size such as to e complementary to the passageway 36 and slide snugly therein over the entire length thereof. When it is desired to fill the accessory with water from the faucet 16, the handle 42 is pushed down, and the slide member 40 will block the opening 38, preventing the flow of water. At this point, if the water should become too deep in the insert, as by leaving the water turned on, or by placing dishes into the insert, the water will overflow the internal wall 26 into the overflow chamber 28, and will pass out of the insert through the opening 30 and flow to the sink drain.

After the dishes have been soaking in the accessory for the desired period of time, one may simply insert a finger into the opening 44 and pull upwardly on the slide 40, thereby allow water to flow through the opening 38, through the opening 39, and into the conventional sink bowl 14 and into the drain 34.

When it is needed to clean the slide gate or valve member 40, the member may be easily removed by pulling upwardly thereon, and the chamber may be rinsed prior to storage.

In another embodiment, the slide member would comprise a valve member such as molded of a hard or semi-hard rubbery material, of a width and thickness substantially the same as the passageway 36 so as to fit snugly therein, with a rod-like handle extending upwardly therefrom. In still another embodiment, the passageway 36 may have a downwardly directed wedge shape, with a correspondingly shaped portion on the end of the handle, such that a firmer downward push of the slide member 40 would result in a tighter fit of the end portion into the walls of the passageway to prevent any leakage of water which might otherwise occur.

In another preferred embodiment, the overflow chamber may be provided with bottom walls 46 which taper from the sides toward the center, in order to direct the flow of overflow water to the opening 30 and out of the accessory.

While this invention has been described as having certain preferred features and embodiments, it will be understood that it is capable of still further variation and modification without departing from the spirit of the invention, and this application is intended to cover any and all variations, modifications and adaptations of the invention as may fall within the spirit of the invention and the scope of the appended claims.

What is claimed is:

1. A liquid holding accessory for use as an insert in a sink, said accessory comprising a bowl having end walls and side walls upstanding from a bottom; an internal wall upstanding from said bottom and being of a height less than the height of said end and side walls so as to form an overflow chamber and a primary chamber in said bowl, a first drain opening in said overflow chamber communicating with the exterior of said accessory, said internal wall having a hollow passageway formed therein and being open at the top thereof and a second drain opening extending through said internal wall and said passageway, valve means in said passageway for selectively opening and closing said second drain opening to allow flow of liquid from said primary chamber through said second drain opening into said overflow chamber.

2. An accessory as in claim 1 and wherein said valve means comprises a slide member in said passageway having a gate portion adjacent one end thereof movable so as to block or open said second drain opening.

3. An accessory as in claim 2 and wherein said slide member is movable between a first position in which said gate portion closes said second drain opening and a second position in which said gate portion opens said second drain opening.

4. An accessory as in claim 2 and wherein said slide member has a handle portion extending above the top of said bowl.

5. An accessory as in claim 4 and wherein said end and side walls are of a height greater than the depth of said sink.

6. An accessory as in claim 5 and including means for spacing said bottom wall above the bottom of the sink.

7. An accessory as in claim 6 wherein said spacing means comprises a pair of ribs formed on the bottom of said bottom wall.

8. An accessory as in claim 6 and wherein said walls and said bottom are integral.

9. An accessory as in claim 3 wherein said slide member includes a handle portion extending upwardly above the top of said walls.

10. An accessory as in claim 9 and wherein said slide member comprises a one-piece molded part.

11. An insert for a sink comprising a bowl member for holding fluid having sides of a height greater than the depth of the sink, and an integral wall of a height less than the height of said sides for separating said bowl member into a primary chamber and an overflow chamber, a first drain opening providing fluid communication between said overflow chamber and the exterior of said insert, and a second drain opening through said internal wall for providing fluid communication between the primary chamber and the overflow chamber, and valve means movable with respect to said internal wall for opening or closing said second drain opening.

12. An insert as in claim 11 and wherein said valve means includes an operating handle extending above the sides of said insert.

13. An insert as in claim 12 and wherein said valve means includes a slide gate movable in a passageway in said internal wall.

14. An insert as in claim 13 and wherein said overflow chamber has side walls tapering inwardly toward said first drain opening.

15. An insert as in claim 13 and wherein said passageway and said slide gate are wedge-shaped.

* * * * *